US006793166B2

(12) United States Patent
Tumilty et al.

(10) Patent No.: US 6,793,166 B2
(45) Date of Patent: Sep. 21, 2004

(54) ORE COMMINUTION PROCESS

(76) Inventors: James Anthony Jude Tumilty, 7B First Avenue, Rivonia, Sandton (ZA); Vilim Ser, 532 Juweel Street, Jukskei Park (ZA); Carlos Mauricio Feldman, 51 Louis Botha Road, Florida Park (ZA); Jan Tjeerd Smit, 42 Thomas Baines Street, Roosevelt Park Extension, Johannesburg (ZA)

( * ) Notice: Subject to any disclaimer, the term of this patent is extended or adjusted under 35 U.S.C. 154(b) by 0 days.

(21) Appl. No.: 10/294,671

(22) Filed: Nov. 15, 2002

(65) Prior Publication Data

US 2003/0116662 A1 Jun. 26, 2003

Related U.S. Application Data

(62) Division of application No. 09/658,560, filed on Sep. 8, 2000, now Pat. No. 6,508,421, which is a continuation of application No. 09/296,249, filed on Apr. 22, 1999, now abandoned.

(30) Foreign Application Priority Data

Apr. 22, 1998 (ZA) ..... 98/3380
Mar. 18, 1999 (ZA) ..... 99/2177

(51) Int. Cl.[7] ..... B02C 19/12
(52) U.S. Cl. ..... 241/78; 241/152.2; 241/235
(58) Field of Search ..... 241/152.2, 76–80, 241/97, 235

(56) References Cited

U.S. PATENT DOCUMENTS

| | | | |
|---|---|---|---|
| 4,824,031 | A | 4/1989 | Wiley |
| 4,840,315 | A | 6/1989 | Rubin et al. |
| 4,892,715 | A | 1/1990 | Horton |
| 4,923,124 | A | 5/1990 | Wiley |
| 4,960,461 | A | 10/1990 | Esna-Ashari et al. |
| 5,205,494 | A | 4/1993 | Durinck et al. |
| 5,280,857 | A | 1/1994 | Reichner |
| 5,549,252 | A | 8/1996 | Walter |
| 5,597,401 | A | 1/1997 | Megy |
| 5,642,863 | A | 7/1997 | Patzelt et al. |

FOREIGN PATENT DOCUMENTS

| | | |
|---|---|---|
| WO | WO91/08836 | 6/1991 |

*Primary Examiner*—Mark Rosenbaum
(74) *Attorney, Agent, or Firm*—Burns, Doane, Swecker & Mathis, L.L.P.

(57) ABSTRACT

The invention provides a method and installation for processing heterogeneous value bearing material by pressure comminution. The material is compressed in a bed of particles, at low pressures and at low bulk material densities, and preferably no more than is necessary to liberate the desired values, thereby to minimise the formation of fines. The compressive bed pressure applied to the material does not exceed 300 MPa, and the process is preferably operated in an open circuit mode. Surprisingly, these measures lead to enhanced liberation of values compared with conventional comminution techniques.

5 Claims, 3 Drawing Sheets

ORE COMMINUTION PROCESS

This application is a divisional of application Ser. No. 09/658,560, filed on Sep. 8, 2000 now U.S. Pat. No. 6,508, 421 and which, in turn, is a continuation of of application Ser. No. 09/296,249 filed on Apr. 22, 1999, now abandoned.

BACKGROUND OF THE INVENTION

THIS invention relates to a method of processing value bearing material such as metal ores, and to an installation for carrying out the method.

SUMMARY OF THE INVENTION

According to the invention there is provided a method of processing heterogeneous value bearing material by pressure comminution, the method comprising compressing the value bearing material in a bed of particles, at low pressures and at low bulk material densities, thereby to liberate the value preferentially and to minimise size reduction of the material beyond the degree necessary for value liberation.

The particulate value bearing material is preferably subjected to a compressive bed pressure not exceeding 300 MPa, and more preferably not exceeding 50 MPa, or still more preferably, not exceeding 30 MPa.

Preferably, the bulk density of the particulate material bed is at least 20% lower than the density of the material making up the particulate.

The value bearing material may be subjected to a plurality of compression cycles.

The voidage of the particulate material bed (ie. the ratio of the bulk density of the particulate material bed to the density of the material making up the particulate) is preferably maintained by suitable intervention, such as a size classification stage, between at least some compression cycles.

The method may comprise compressing the value bearing material in an open circuit mode. By "open circuit mode" is meant that the crushed material or part thereof is not recycled with feed material.

The method preferably results in desired proportions of a fine fraction enriched in a selected phase, mineral or metal and a coarse fraction depleted of said phase, mineral or value being produced, the fine fraction being separated from the coarse fraction for further processing of at least one of the fractions.

The coarse fraction may be discarded, or the crushing step may be repeated on the coarse faction, with the resulting crushed material being separated into a second coarse fraction and a second fine fraction, with a selected phase, mineral or value being recovered from the second fine fraction.

The separation of the coarse and fine fractions after crushing of the material is preferably carried out with a cut size calculated according to desired values of mass, value recovery and value grade in the coarse and fine fractions.

The heterogeneous value bearing material may be natural or synthetic, and will typically comprise metalliferous ore, a concentrate, a matte or a slag.

The heterogeneous material may be, for example, a base metal ore, gold ore, diamond ore, platinum ore, or titanium slag.

Further according to the invention there is provided an installation for processing heterogeneous value bearing material by pressure communication comprising:

at least a first crusher arranged to subject the value bearing material to one or more compression cycles in a bed of particles;

control means for adjusting the operation of the crusher so that the value bearing material is subjected to bed pressures not exceeding 300 MPa, in order to produce desired proportions of a value-enriched fine fraction and a value-depleted coarse fraction, thereby to liberate said value preferentially while minimising size reduction of the material beyond the degree necessary for value liberation; and at least first separating means for separating the fine fraction from the coarse fraction of the crushed material.

The control means is preferably arranged to adjust the operation of the crusher so that the value bearing material is subjected to bed pressures not exceeding 50 MPa, and preferably not exceeding 30 MPa.

The separating means is preferably arranged to maintain a desired material bed voidage value so that the bulk density of the bed of particulate material is less than the density of the material making up the particulate.

The first device is preferably adjustable in accordance with the natural particle size of the value bearing compound or mineral within the heterogeneous material, thereby to minimise size reduction of the material beyond the degree necessary for value liberation.

The separating means for separating the fine fraction from the coarse fraction is preferably arranged such that the generation of ultrafines within the installation is minimised.

The installation may include at least a second crusher, the second crusher being arranged to be fed with the coarse fraction of the output of the first crusher; and at least second separating means for separating a fine fraction from a coarse fraction of the output of the second crusher.

DESCRIPTION OF PREFERRED EMBODIMENTS

Figure 1:
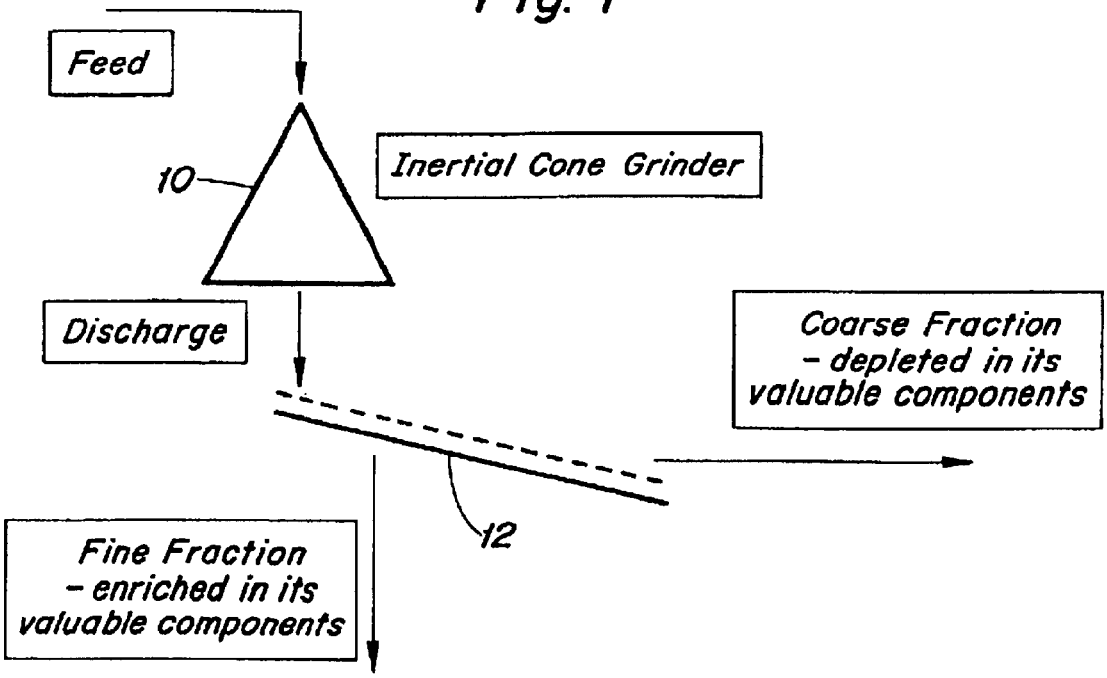
FIG. 1 is a schematic illustration of a processing system for carrying the process according to the invention.

The present invention has particular application to the comminution of natural or synthetic heterogeneous value bearing materials such as base metal ores, gold ores, platinum ores, diamond ores, metalliferous slags, mattes etc. It has been established that compression breakage in a bed of particles, also known as inter-particle comminution, results in preferential cracking of particles along grain boundaries. This liberates valuable minerals from the heterogeneous materials, with minimum breakage of the gangue constituents, which tend to be present in the material as discrete grains or pebbles.

In this regard, the formation of ultrafines takes place mainly in the damage zones on points of particle contact. The resulting fragments may fracture further, if the compression event is extended in time, and no open space is available for these fragments to fall into. In such a case, the formation of ultrafines is increased, with commensurate energy consumption during comminution and, significantly, limitations both to the choice of downstream operations and the efficiency of such operations.

The present invention relies on the application of low compressive pressures, and also incorporates the step of maintaining a certain minimum voidage or bulk density of the particulate material bed. An objective of the method of the invention is the maximum liberation of values at natural size, i.e. minimum formation of fines. This contrasts with conventional compressive comminution, as in cement grinding or coal pulverisation, where the formation of fines is the objective, and compressive pressures are consequently high.

The application of these principles causes the liberation of values from heterogeneous materials, with minimum breakage of the gangue constituents, which tend to be present in the material as discrete grains or pebbles. Also, the comminution of liberated values, which is generally undesirable, as excessive size reduction of values often renders downstream beneficiation more difficult, is minimised. At present, in fact, such excessive size reduction limits the operator to flotation and leaching as a means of further beneficiation.

The essence of the present invention involves subjecting materials of the kind mentioned above to a size reduction or crushing process comprising one or more compressions at relatively low pressures, preferably below about 50 MPa, or even 30 MPa, but in any case below 300 MPa, in an environment which is designed to minimise continued compression of fracture products.

The liberation process is preferably operated in open circuit with respect to the comminution step or steps, a method at odds with present comminution technology, but may be found to operate satisfactorily in closed circuit as well, depending on the characteristics of the feed material and the aims and methods of subsequent downstream processing.

Data from batch tests performed by the applicant, investigating the fundamentals of mineral liberation, has demonstrated that single stage compression at low pressures greatly increases liberation of valuable species. Application of these concepts in a pilot plant has shown, surprisingly, that the use of relatively low pressures and the intensive application of size classification in order to maintain a loose particulate bed, lead to the enhanced liberation of valuable species, with minimised generation of fines, as required by the downstream process. This effect is not obtained with conventional comminution, at least not to any great extent, and is not obtained with high-pressure and/or high-bed-density pressure comminution.

If, however, the material composition is such that the value material by nature is finer grained than the gangue constituents, the process of the invention may be operated to cause preferential deportment of the value species to the finer size fractions and subsequent rejection of the matrix, again without wasteful generation of fines of any of the constituents.

When the product is screened, this results in splitting of the ore into a coarse, low-grade fraction and a fine, high-grade fraction. In other words, the process of the invention causes preferential deportment of the valuable minerals to the finer size fractions of the product.

Batch compression, as well as pilot testing, have also demonstrated that the deportment of valuable mineral is dependent on the pressure exerted on, and the energy imparted to the ore during pressure comminution thereof. The upgrading of the valuable mineral in the fine fraction is, surprisingly, significantly enhanced at lower energies and pressures, typically below 50 MPa and preferably below 30 MPa. It was also found that lower pressures are more effective at depleting coarse fractions of valuable mineral than high pressures.

Referring now to the highly simplified diagram of FIG. 1, a crusher 10, which in the prototype installation was a Rhodax 300 inertial cone grinder, was fed with material having a top size of 45 mm. The material was subjected to a pressure comminution crushing action in the crushing chamber of the machine. The maximum pressure in the crushing chamber did not exceed 30 MPa, and in fact was measured at 17 MPa. Each particle is subjected to multiple compression cycles before being discharged. The gap setting in the crushing chamber was 12 mm and the rotational speed of the unbalanced masses was 1700 revolutions per minute. The achieved throughput was 6.4 tons per hour and the net power consumption 3.2 kWh/ton.

The crushed material was then discharged onto a classifier or separator 12 which separated the discharge into two size fractions, a coarse fraction containing material larger than the cut size of the separator, and a fine fraction comprising all of the material smaller than the cut size. The screen size used to classify the discharge was 3 mm.

Importantly, the coarse fraction was not returned to the crusher. In other words, the crusher was operated in an open circuit mode, with none of the crusher discharge being re-circulated to the crusher with the feed.

Figure 3:
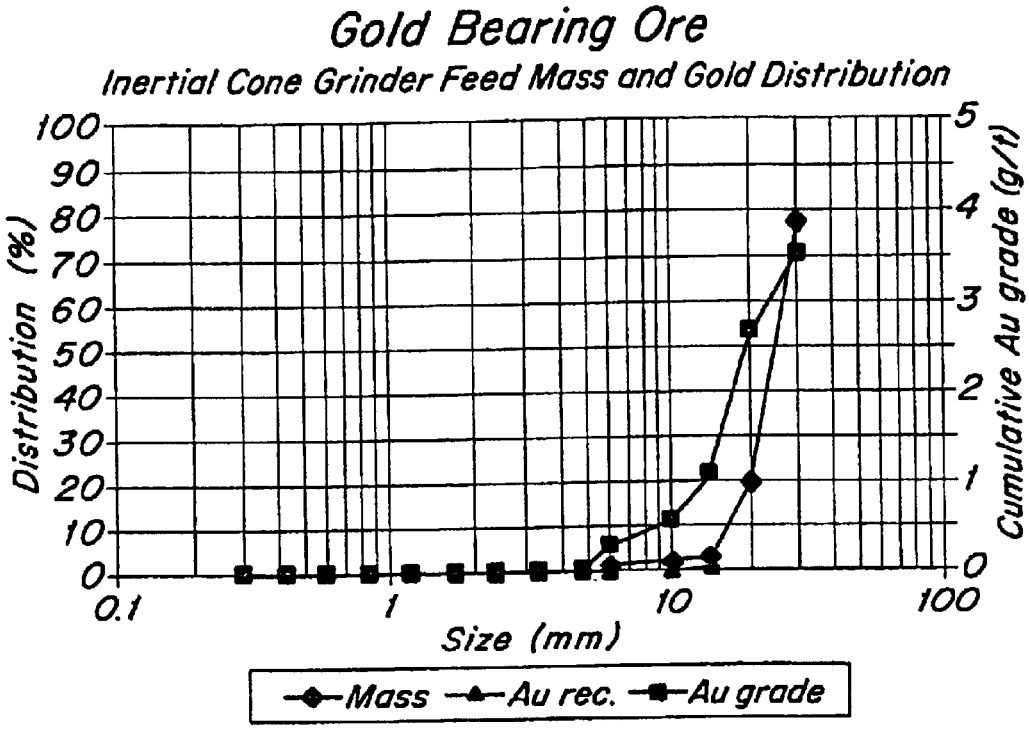
FIG. 3 is a graph showing a relationship between fraction size and gold presence in material fed to a grinder.
Figure 4:
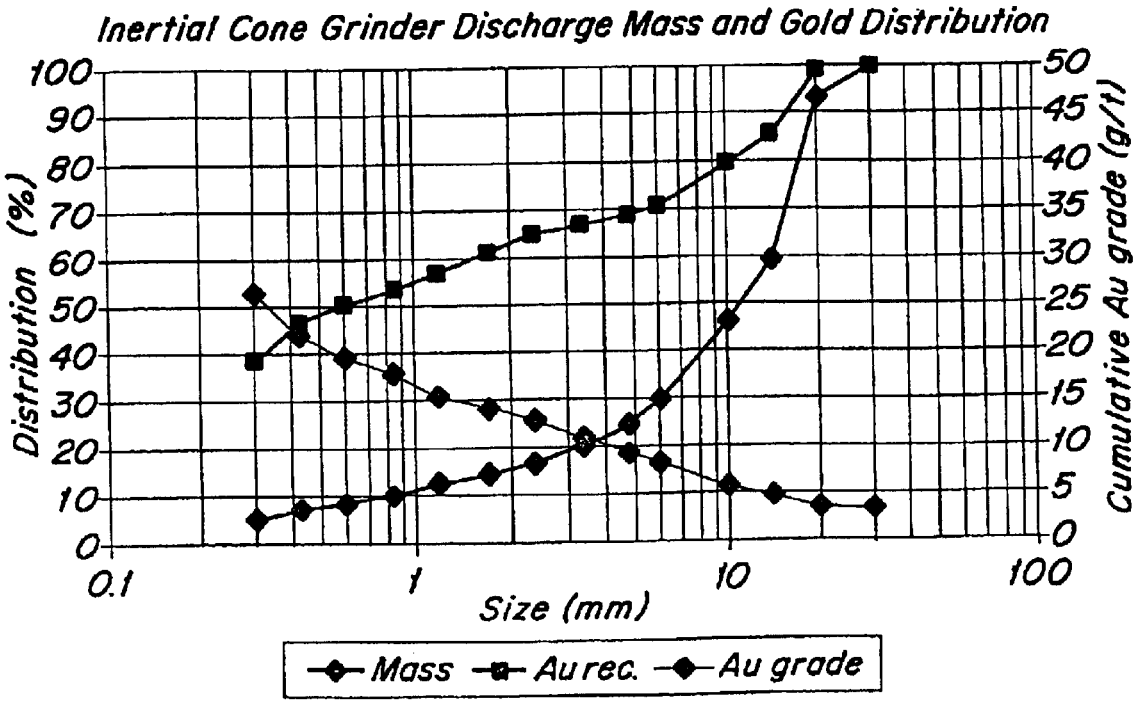
FIG. 4 is a graph similar to FIG. 3 showing a relationship between fraction size and gold presence in material leaving the grinder.

The gold grade of the coarse and fine fraction was determined, and it was found that a significant upgrading of gold occurred in the fine fraction, while the gold grade of the coarse fraction was depleted. This is indicated in the graphs of FIGS. 3 and 4. FIG. 3 is a graph showing the characteristics of the feed to the crusher 10, which shows a typical gold deportment by size, with the gold recovery curve (triangular marker) following the mass distribution (diamond marker) in each size very closely. This means that the percentage of gold occurring in a certain size fraction equals the mass percentage of material in that fraction. The shape of the gold grade (square marker) also follows the mass distribution. By comparison, the graph of FIG. 4 shows the characteristics of the output of the crusher 10.

The crusher discharge is significantly finer, with more mass reporting to the finer size fractions. The gold recovery and gold grade curves have completely separated from the mass distribution curve, which clearly shows the beneficial effect of open-circuit low pressure comminution on heterogeneous ores.

Specific examples of the processing method of the invention, as compared with the currently conventional size reduction system, are set out below.

EXAMPLE 1

A gold ore from the Witwatersrand, containing 3.5 g/ton gold, was comminuted, according to the methods of the invention, in a semi-industrial scale inertial cone grinder. Results were as follows:

| | Inertial cone grinder feed | | Inertial cone grinder product | | |
|---|---|---|---|---|---|
| Size passing (mm) | Cumulative mass(%) | Cumulative gold recovery (%) | Cumulative mass(%) | Cumulative gold recovery (%) | Cumulative gold grade (g/ton) |
| 30 | 77.3 | 77.3 | 100.0 | 100.0 | 3.45 |
| 20 | 18.7 | 19.1 | 93.1 | 98.5 | 3.65 |
| 14 | 2.2 | 1.0 | 59.3 | 85.1 | 4.95 |
| 10 | 1.4 | 0.8 | 46.5 | 79.3 | 5.88 |
| 6 | 1.1 | 0.6 | 30.1 | 70.5 | 8.08 |
| 4.75 | — | — | 25.1 | 68.8 | 9.47 |
| 3.36 | — | — | 20.5 | 67.1 | 11.30 |
| 2.36 | — | — | 17.2 | 65.2 | 13.11 |
| 1.7 | — | — | 14.7 | 61.0 | 14.31 |
| 1.18 | — | — | 12.7 | 56.9 | 15.50 |
| 0.85 | — | — | 10.2 | 53.1 | 17.89 |
| 0.6 | — | — | 8.8 | 50.1 | 19.61 |
| 0.425 | — | — | 7.4 | 46.5 | 21.83 |
| 0.3 | — | — | 5.1 | 35.7 | 26.3 |

The upgrading of valuable mineral in the fine fraction makes it possible to screen the product at a certain size and retain most of the gold, but only part of the mass, in the fine fraction. The gold grade of the fine fraction will then be significantly higher than the gold grade of the bulk sample, prior to size reduction or crushing and screening. In this example, screening the product at 10 mm would result in 46.5% of the mass, and 79.3% of the gold, reporting to the fine fraction, at a grade of 5.9 g/ton, whilst rejecting a coarse fraction at a grade of 1.3 g/ton.

The cumulative gold grade of the feed material is 3.5 g/ton. This, of course is still true for the discharge. However, where the gold grade of the −3 mm fraction of the feed is almost zero, the gold grade of the same fraction of the discharge is now more than 11 g/ton.

The gold recovery curve illustrates this further. In the case of the feed material, 19% of the total mass is smaller than 20 mm and this contains 18.7% of the total gold. In the case of the discharge, only 20.5% of the total mass is smaller than 3 mm, but 67% of the total amount of gold is found in this fraction.

Note that the data for these tests was obtained in a continuous pilot plant semi-industrial scale Rhodax Inertial Cone Grinder. Other devices operating on similar principles would also be suitable.

An important operating variable in this circuit strategy is the size at which the discharge is classified. The effect of changing the cut size on both the percentage split by mass of material reporting to the coarse and fine fraction and the grade and recovery of valuable mineral in the two fractions is shown in FIG. 5.

Figure 5:
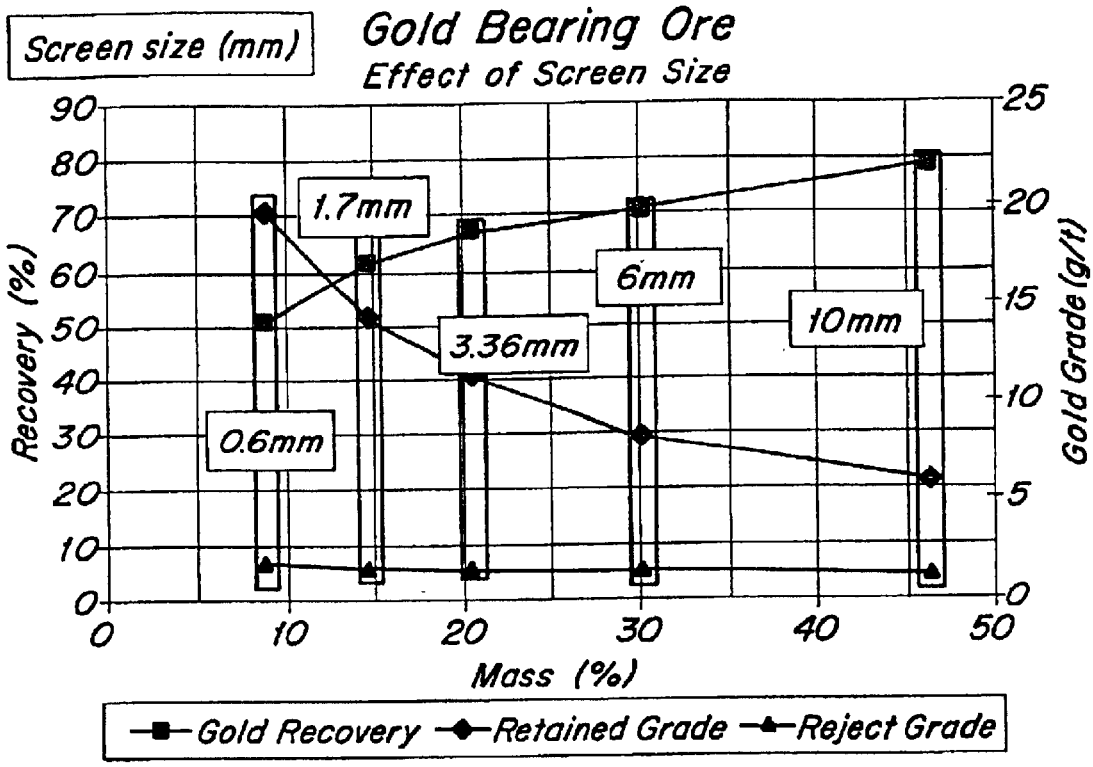
FIG. 5 is a graph showing the effect of screen size on gold recovery.

It should be clear from FIG. 5 that it is possible to manipulate the mass recovery, gold recovery and gold grade in the fine and coarse fraction by changing the screen size at which the discharge is classified. This is valid for the currently explained case of gold, as well as for copper, nickel and others for which the data is presently being analysed. For the present example, with a screen size of 1.7 mm, just under 15% of the total mass would report to the fine fraction. This material would contain 61% of the total gold at a grade of 14.3 g/ton. The gold grade of the coarse fraction (reject grade) is 1.6 g/ton. With a screen size of 10 mm, 46.5% of the mass would report to the fine fraction, containing 79% of the gold at a grade of 5.9 g/ton. This time the reject grade has dropped to 1.3 g/ton.

Experimental results have further shown that it is possible to subject the coarse fraction to the same comminution strategy and observe a similar trend of gold reporting to the fine fraction of the open-circuit pressure comminution discharge. Again, the material must be crushed in a low pressure inter-particle comminution device in open circuit and the discharge screened into a coarse and fine fraction. It must be emphasised that this does not constitute closing the circuit, but is in fact a second open circuit crushing stage, with the feed to the second crusher being the coarse fraction from the first stage.

Figure 6:
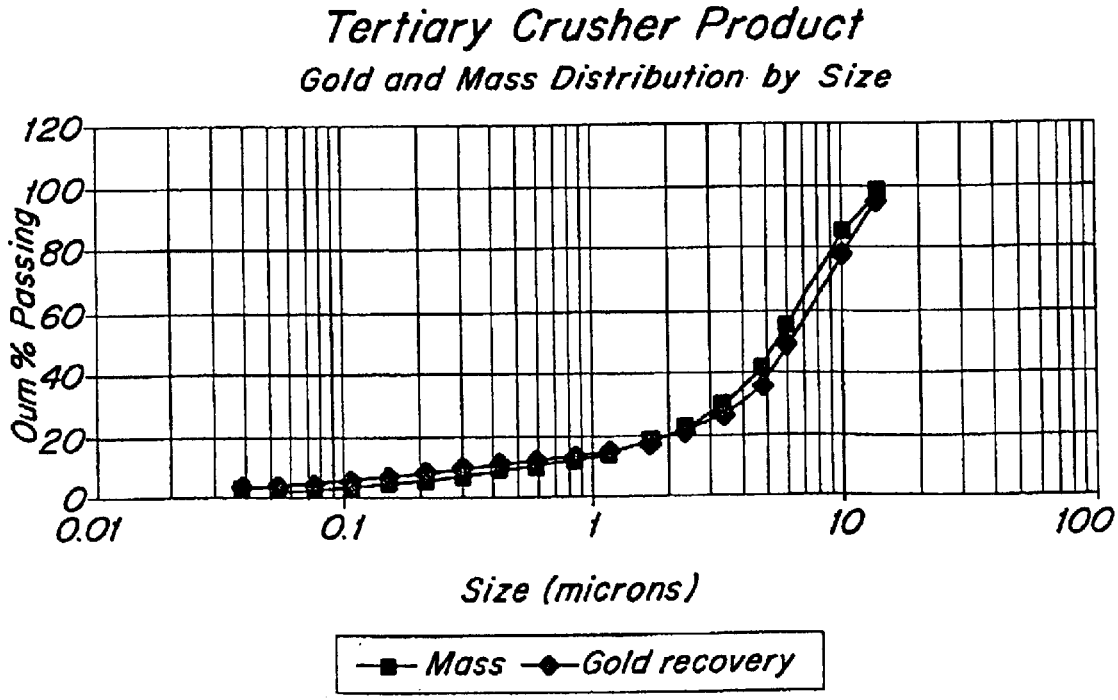
FIG. 6 is a graph showing the relationship between gold recovery and fraction size using a conventional crusher.

An experiment was carried out to compare the results of using the method of the present invention with the results of using a conventional crusher. A conventional crusher is defined as a crushing device that does not depend on a controlled pressure to fragment ore, but instead usually depends on the movement of an eccentric shaft to generate an impact force on the ore. Such devices are known, for example, as jaw-crushers, gyratory crushers or cone crushers. The results of the comparative test, illustrated in FIG. 6, show that no upgrading of valuable mineral in the fine fraction occurred with conventional crushing.

The liberation characteristic of a mineral of interest is defined as the ratio of that mineral's area to the area of the total particle, when a polished section for microscopic examination is prepared of such particle, according to the art. Only particles containing the mineral of interest are studied. The liberation characteristics of the particles containing are then classified into three classes, a ratio of 0–25% being designated "locked", 25–75% being designated "middlings" and 75–100% being designated "liberated".

EXAMPLE 2

A copper sulphide ore was ground to 100% passing 425 microns, both in a laboratory ball mill and, according to the invention, by repeated compression and classification. The size fraction from 212 to 425 microns was then analysed for copper liberation characteristics. Results were as follows:

| Comminution Method | % locked | % middlings | % liberated |
|---|---|---|---|
| Compression 10 Mpa | 19.7 | 32.3 | 48.0 |
| Compression 40 Mpa | 20.4 | 28.1 | 51.5 |

-continued

| Comminution Method | % locked | % middlings | % liberated |
|---|---|---|---|
| Compression 50 Mpa | 18.5 | 20.8 | 60.7 |
| Compression 100 Mpa | 17.8 | 23.2 | 59.0 |
| Ball mill | 31.1 | 30.9 | 38.0 |

EXAMPLE 3

Subsequently, pilot milling work was performed, in which a nickel sulphide ore was ground to various degrees, both in a laboratory rod mill, a laboratory semi-autogenous mill, and according to the invention, in an air drafted vertical roller mill. The objective, dictated by the performance characteristics of the subsequent froth flotation process that is applied as per the existing art, was to cause the nickel to report to sizes below 150 microns, preferably between 38 and 150 microns, whilst minimising the amount of gangue being ground to finer than 38 microns. These product characteristics are considered most advantageous in subsequent sulphide flotation processes. The results were as follows (pressures quoted are approximate peak pressures):

| Comminution Method | %−38μ(bulk) | %−38μ (nickel) | %+38−150μ (nickel) | %−150μ (nickel) |
|---|---|---|---|---|
| Rod mill 1 | 17.95 | 21.56 | 13.86 | 35.42 |
| Rod mill 2 | 31.00 | 35.60 | 57.36 | 93.00 |
| SAG mill | 44.70 | 51.43 | 33.60 | 85.03 |
| VR mill 1: 20 Mpa | 19.06 | 23.01 | 40.40 | 63.41 |
| VR mill 2: 40 Mpa | 18.56 | 22.90 | 39.88 | 62.78 |
| VR mill 3: 40 Mpa | 27.5 | 32.28 | 57.05 | 89.33 |

The superior nickel size deportment, whilst lowering gangue deportment to ultrafine fractions, resulting when applying the concepts of the invention, is demonstrated convincingly by these results.

It is believed that application of the invention can liberate the industry from the limitations imposed by fine milling. Fine milling necessitates the use of downstream processes geared towards fine particle recovery, like froth flotation and leaching. The coarser product size distributions generated by the method of the invention now allow the use of a wider range of methods of discrimination, including screening, heavy media separation, and others, including newer methods such as those disclosed in South African patent applications nos. 97/10731, 98/6318 and 98/7306, notwithstanding that the conventional methods of froth flotation and leaching are mentioned in the examples and applications.

The invention is believed to have a number of applications in the mining and metallurgical industry. These include the following:

Underground Ore Pre-Concentration

The proposed comminution strategy can reduce mining costs as underground pressure comminution crushing of ore, followed by screening at the correct size, will reduce the amount of material that has to be trammed horizontally and hoisted vertically, without significant gold loss. The coarse fraction can then be used as backfill. The fine, high-grade fraction can be pumped and/or hoisted to the surface. Where slurry is pumped to the surface, cyanide and lime can be added to the slurry underground. The high pressure in the pipeline will improve gold leach kinetics to such an extent that most of the reaction can be complete by the time the slurry reaches the surface. This will further reduce operating costs or increase the processing capacity of the metallurgical plant.

Applications on Metallurgical Plants

Open circuit low pressure inter-particle comminution has several significant implications for metallurgical plants. Preferential cracking of ore particles along grain boundaries liberates minerals. This reduces the required fineness to which the ore has to be milled for the same degree of liberation of valuable mineral. At the same time, this minimises unnecessary grinding of the liberated minerals, mostly an undesirable effect for downstream processes. These properties can be exploited in the following ways:

Milling Applications

Milling circuits, fed by open circuit Rhodax inertial cone grinder discharge, or the discharge from other comminution devices operating on similar principles, can be operated at higher throughputs, as the required product grind for mineral liberation will be significantly coarser.

Figure 2:
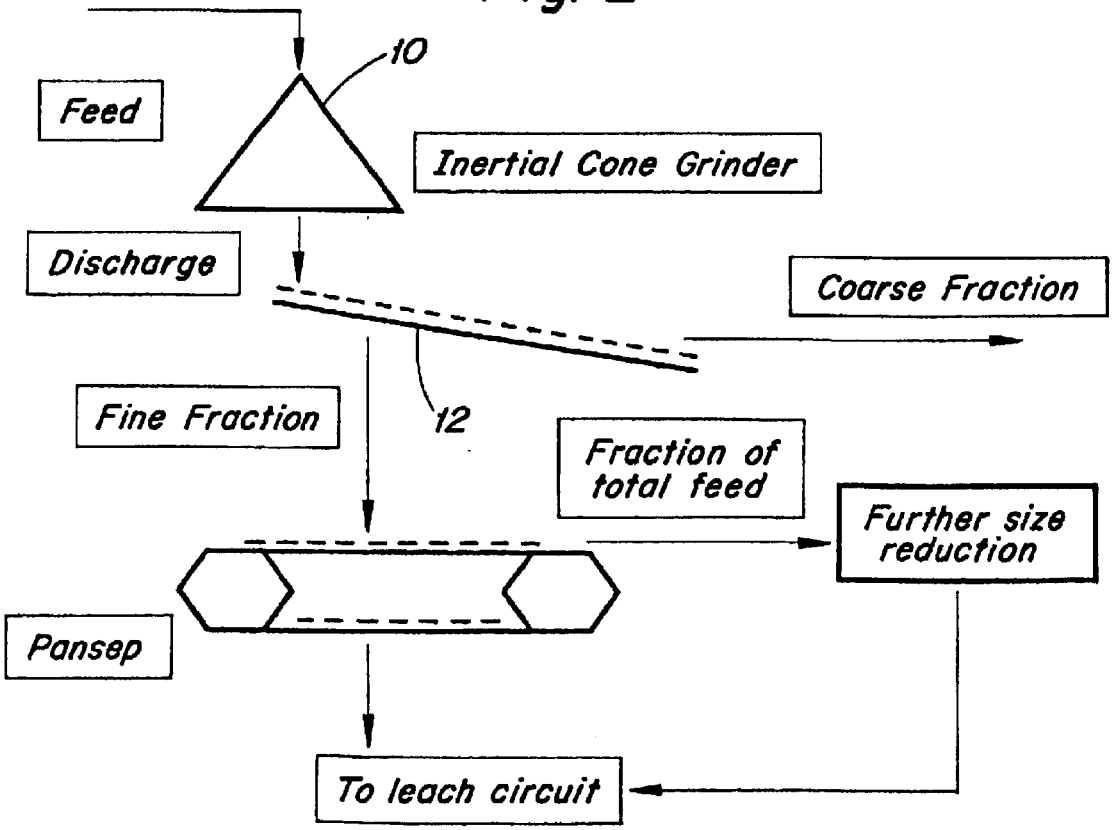
FIG. 2 is a schematic illustration of an alternative processing system utilizing a panstep classifier and a leach circuit.

In one embodiment, the fine, high-grade fraction produced by pressure comminution devices can be classified again by the Pansep classifier, for instance, this time at a much finer cut-point. This cut-point is of such a nature that the under size material is fine enough so that it can be kept in suspension in leach vessels. In other words, a proportion of the pressure comminuted material can be fed directly to the leach circuit. The over size material of the second classification step will be subjected to a further comminution step before it can be leached. However, this is but a fraction of the total feed to a conventional milling circuit. (See FIG. 2).

Downstream Processes

The coarser product grind from the milling circuit will have a positive effect on downstream processes such as flotation circuits. Very fine material has a detrimental effect on the performance of flotation circuits. Normally, these fines are unavoidable, as milling circuits have to grind to a specified degree of fineness in order to achieve liberation. With the open circuit low pressure configuration, as explained previously, the same degree of liberation can be achieved at coarser product grinds, implying higher recovery and improving reagent utilization.

The increased liberation of valuable mineral will improve the performance of leach circuits in terms of both required residence time, which will decrease, and recovery of valuable mineral, which will increase.

Waste Rock Pre-Concentration

Enormous surface rock dumps characterise many mining operations. These dumps, although containing valuable mineral, are uneconomical to treat in conventional metallurgical plants, as the mineral grade is too low. However, the fact that it is now possible to crush such material in a low pressure comminution device, classify the crushed product and screen it into a fine high-grade fraction and coarse low-grade fraction, creates the opportunity to extract the valuable mineral from waste dumps profitably, either in a conventional metallurgical plant or in a heap leach operation.

Treatment of Slags

Large quantities of synthetic materials, in the form of slags, are available around the world. They contain significant amounts of copper, nickel and other valuables, which can be effectively liberated and concentrated by means of the present invention, thereby facilitating the overall recovery process.

Preparation of Froth Flotation Feed

The proposed comminution strategy can reduce size reduction cost, as a given froth flotation performance, in terms of value recovery and product quality, can be achieved at coarser particle sizes than is possible by conventional size reduction. This applies especially to raw materials which contain naturally floating, and/or very easily overground phases.

Preparation of Heap Leach Feed

The greater degree of value liberation achieved by application of the principles which are the subject of the current invention, allows heap leach feed to be prepared at coarser particle size than is possible by the application of conventional techniques. A conventional technique is defined as a technique that does not depend on a controlled pressure to fragment particular material, but instead usually depends on forced passage of particulates through a given opening (as in most jaw crushers, cone crushers, and such like), or impact and abrastion (as takes place in current ball mills, rod mills, autogenous mills, semi-autogenous mills, and the like). The coarser particle size of heap leach feed allows greater heap leach percolation rates and better air penetration into the body of the heap, causing faster leach kinetics and higher extractions than conventionally possible.

It will be appreciated from the above description that the method of the invention can provide numerous benefits in mining operations. In underground mining, use of the method can reduce cost by reducing the quantity of material hoisted to the surface. Used in conjunction with conventional milling circuits, the method of the invention results in improved mineral liberation, reduced grind, increased throughput and decreased mill feed. In downstream beneficiation processes, the method of the invention results in fewer fines in flotation circuits, less over-grinding of valuable minerals and improved leach kinetics, recovery and reduced reagent consumption. The invention also lends itself to the treatment of waste dumps or low-grade ores by heap leaching.

We claim:

1. An installation for processing heterogeneous value bearing material by pressure comminution comprising:

at least a first crusher arranged to subject the value bearing material to one or more compression cycles in a bed of particles;

a controller for adjusting the operation of the crusher so that the value bearing material is subjected to a compressive bed pressure of less than 50 MPa, in order to produce desired proportions of a value-enriched fine fraction and a value-depleted coarse fraction, thereby to liberate said value preferentially while minimizing size reduction of the material beyond the degree necessary for value liberation; and at least a first separator for separating the fine fraction from the coarse fraction of the crushed material;

wherein the first separator is arranged to maintain a desired material bed voidage value so that the bulk density of the bed of particles is at least 20% lower than the density of the material making up the bed of particles.

2. An installation according to claim 1 wherein the controller is arranged to adjust the operation of the crusher so that the value bearing material is subjected to bed pressures not exceeding 30 MPa.

3. An installation according to claim 1 wherein the controller of the first crusher is adjustable in accordance with the natural particle size of the value bearing compound or mineral within the heterogeneous material, thereby to minimize size reduction of the material beyond the degree necessary for value liberation.

4. An installation according to claim 1 wherein the first separator is arranged such that the generation of ultrafines within the installation is minimized.

5. An installation according to claim 1 including at least a second crusher, the second crusher being arranged to be fed with the coarse fraction of the output of the first crusher; and at least a second separator for separating a fine fraction from a coarse fraction of the output of the second crusher.

* * * * *